US009862540B2

(12) United States Patent
Gillard

(10) Patent No.: US 9,862,540 B2
(45) Date of Patent: Jan. 9, 2018

(54) SYSTEM FOR COMPLETE DISPENSING OF FLOWABLE MATERIALS FROM A BULK SHIPPING CONTAINER

(71) Applicant: International Paper Company, Memphis, TN (US)

(72) Inventor: David Frederick Gillard, Noblesville, IN (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 54 days.

(21) Appl. No.: 15/205,103

(22) Filed: Jul. 8, 2016

(65) Prior Publication Data

US 2017/0008697 A1 Jan. 12, 2017

Related U.S. Application Data

(60) Provisional application No. 62/190,955, filed on Jul. 10, 2015.

(51) Int. Cl.
*B65D 88/62* (2006.01)
*B65D 88/16* (2006.01)
(Continued)

(52) U.S. Cl.
CPC ..... *B65D 88/62* (2013.01); *B65D 77/061* (2013.01); *B65D 77/067* (2013.01); *B67D 7/0244* (2013.01); *B65B 69/005* (2013.01); *B65D 83/0072* (2013.01); *B65D 88/1612* (2013.01); *B67D 7/3254* (2013.01); *B67D 7/3263* (2013.01); *B67D 2001/0828* (2013.01)

(58) Field of Classification Search
CPC .. B65D 88/62; B65D 88/1612; B65D 77/067; B65D 77/061; B65D 83/0072; B67D 7/3263; B67D 7/3254; B67D 7/0244; B67D 2001/0828; B65B 69/005
See application file for complete search history.

(56) References Cited

U.S. PATENT DOCUMENTS 2,956,839 A * 10/1960 Hermanns ..... B65D 88/62 222/386.5
3,294,289 A * 12/1966 Bayne ..... B67D 1/0462 222/386.5
(Continued)

FOREIGN PATENT DOCUMENTS

GB 1241162 7/1971

*Primary Examiner* — Frederick C Nicolas
(74) *Attorney, Agent, or Firm* — Matthew M. Eslami; Thomas W. Ryan

(57) ABSTRACT

The present invention is directed to a system for fully dispensing liquid from a bulk shipping container. The system includes a bulk bin and a cassette disposed therein. The cassette includes a cassette board, a liquid bag having inlet and outlet ports and an air inflated bag that is attached to the liquid bag. The air bag includes an air inlet port formed at one end thereof and used for inflating the air bag from a source of pressurized air. The air bag further includes an obstruction region defined by a weld line that is formed on an opposite end from the air inlet port to redirect the pressurized air within the air bag when inflating the air bag reaches a level at which the pressurized air counteract the liquid pressure within the liquid bag so as to urge the liquid toward the outlet port of the liquid bag.

17 Claims, 15 Drawing Sheets

(51) Int. Cl.

| | |
|---|---|
| ***B65D 83/00*** | (2006.01) |
| ***B65D 77/06*** | (2006.01) |
| ***B67D 7/02*** | (2010.01) |
| *B67D 7/32* | (2010.01) |
| *B67D 1/08* | (2006.01) |
| *B65B 69/00* | (2006.01) |

(56) References Cited

U.S. PATENT DOCUMENTS

| | | | | |
|---|---|---|---|---|
| 4,796,788 | A * | 1/1989 | Bond | B65D 77/067 222/105 |
| 5,096,092 | A * | 3/1992 | Devine | B67D 1/0462 222/105 |
| 5,335,820 | A | 8/1994 | Christianson | |
| 6,234,351 | B1 * | 5/2001 | Wilcox | B65D 77/06 222/386.5 |
| 6,427,873 | B2 * | 8/2002 | Wilcox | B65D 77/06 222/386.5 |
| 6,481,598 | B1 * | 11/2002 | Thornsen | B65D 88/62 220/1.6 |
| 7,954,670 | B2 * | 6/2011 | Stuart | B65D 77/06 222/105 |
| 8,141,750 | B2 * | 3/2012 | Ingvarsson | B65G 65/46 222/203 |
| 2001/0002675 | A1 * | 6/2001 | Wilcox | B65D 77/06 222/95 |
| 2008/0310766 | A1 | 12/2008 | Plunkett | |
| 2013/0292412 | A1 * | 11/2013 | Jones | B67D 3/042 222/81 |

* cited by examiner

SYSTEM FOR COMPLETE DISPENSING OF FLOWABLE MATERIALS FROM A BULK SHIPPING CONTAINER

CROSS REFERENCE TO RELATED APPLICATION

This application claims priority to U.S. provisional patent Application Ser. No. 62/190,955, filed on Jul. 10, 2015, which is hereby incorporated hereinto by reference as if fully restated herein.

FIELD OF THE INVENTION

This invention relates to bulk shipping containers and more particularly, to an improved system for complete dispensing of flowable materials contained in a bulk bin and bag combination or bag-in-box. The bag-in-box, as known in the art, is type of a container for the storage and transportation of liquid or semi-liquid material.

BACKGROUND OF THE INVENTION

Bulk material shipping containers often contain products that are viscous or sticky, thus the products don't flow easily or they adhere to the plastic bag when being dispensed. The result is more residual product left in the plastic bag which becomes expensive waste and a disposal issue for the users. To address this problem, one general prior art solution has been specially designed bags which help in getting the product dispensed.

The prior art has attempted several approaches to overcome this problem. For example, one design approach forces the product to the center of the plastic bag where it can be dispensed out of the top of the plastic bag. Another design approach forces the product to the outlet valve on the bottom of the front panel of the box where it is typically pumped out of the container. These two design approaches incur high cost and complexity and the bag that is used is a three ply bag that has a series of welds between the outer and middle ply that allow air to be inserted between the outer and middle ply in a way so as to force the product inside of the bag to the outlet point.

Another prior art approach was to take a standard form fit bag made with two plies plastic film and then a separate pillow bag is welded it to the form fit bag outside the containment areas. In this approach the pillow is welded to the trim areas of the form fit bag. When air is inflated into this separate pillow bag, it forces the product inside the form fit bag towards the outlet valve. These bags are expensive to make as there are two bags to be made and an off-line process to weld the two plastic bags together. The aforementioned prior art bags' performances are comparable to one another, but not significantly better or worse.

Therefore, there is need for a simple, inexpensive, and effective design to completely evacuate the flowable materials from the bag-in-box.

SUMMARY OF THE INVENTION

The present invention uses a separate pillow bag and attaching the pillow bag to a product bag that creates an air inflated bag. The invention uses a double sided tape to attach both of the air inflated and product bags to a cassette board and this tape adheres to the plastic bags very well. Therefore, it would be advantageous attaching or taping two plastic bags together, which is a much less costly process than welding them together and a more flexible product offering as to the plastic bags could be made on demand. Although a double sided tape is used for attaching the two plastic bags together, but one of the ordinary skill in the art would appreciate that a wide variety of attaching means such as staple, heat seal, and the likes can be utilized.

The separate air inflated plastic bag functions by inflating at the top of the bulk bin or tote or box or container starting at the back of the bin opposite to the dispensing outlet valve location. As the air bag inflates, it forces the product inside the product bag moves forward toward the side of the bulk bin or tote where the dispensing outlet valve is located. As the air bag continues to inflate and the liquid level of the product bag gets low enough, the air starts to force its way across the bottom of the bin or tote towards the dispensing outlet valve. Since the air inflated bag resembles a pillow bag it inflates in a round manner which forces the product in the middle of the bin toward the dispensing outlet valve faster than the product along the sides of the product bag. Eventually the product forces its way across far enough such that it forces the product bag to cover up the dispensing outlet, trapping product in the front corners of the bag. Therefore, a goal of the invention was to provide a way that the air inflated bag would force the product out of the corners of the product bag prior to closing off the dispensing outlet valve. After a series of trial attempts, it was learned that applying a weld line across a portion of the air bag positioned in front of the dispensing outlet valve or port, would prevent the air bag from reaching the dispensing outlet valve or port. When the air bag is inflated up to this weld line or point, the air was forced around the sides of the air bag causing the air bag to push into the corners of the air bag which, in turn, forces the product inside the product bag towards the middle and the dispensing outlet valve. Eventually the air fills up the air inflated bag underneath the product bag which lifts the product bag up to the dispensing outlet valve so as to fully evacuate the product bag. The invention achieves a substantial improvement over the prior art bags. The product bag is tested with products such as glue which produced remarkable results.

The present invention is directed to a system or an apparatus and method for complete dispensing of bulk material from a product bag disposed in a bulk bin or tote. The product bag is a three ply plastic bag and the air inflated bag is a two ply plastic bag. However, one of ordinary skill in the art would appreciate that each of the product bag and the air inflated bag may be one, two, three, four plies or any combination thereof. One advantage of the respective product bag and air inflated bag is their higher quality plastic material, but yet the total cost of the respective plastic bags is significantly less than the prior art bags. Furthermore, the ability to glue tape an air inflated bag to any stock product bag provides much greater flexibility in our product offerings without increased inventory.

Accordingly, one aspect of the present invention is directed to a system for fully dispensing flowable bulk material from a bulk shipping container. The system comprises a tote or a bulk bin having a dispensing opening. A first flexible bag is disposed inside the bulk bin. The first flexible bag includes an inlet port for receiving the flowable bulk material and an outlet port for dispensing the flowable bulk material from the first flexible bag. The outlet port of the first flexible bag is inserted into the dispensing opening. A second flexible bag is removably attached to the first flexible bag. The second flexible bag includes an air inlet port that is formed at one end thereof and is used for inflating the second flexible bag from a source of pressurized air. The second flexible bag further includes an obstruction region defined by a weld line that is formed on an opposite end from the air inlet port to redirect the pressurized air within the second flexible bag. When inflating the second flexible bag reaches a level at which the pressurized air counteract the flowable material pressure within the first flexible bag so as to urge the flowable bulk material toward the outlet port of the first flexible bag.

Another aspect of the present invention is directed to a method of fully dispensing liquid or semi-liquid material from a plastic liquid bag contained in a bulk container. The method comprising the steps of attaching a plastic air bag to the plastic liquid bag in which the plastic air bag includes an air inlet port formed at one end and an obstruction region defined by a weld line formed on an opposite end thereof. Next, connecting the air inlet port to a source of pressurized air for inflating the plastic air bag in which inflating the plastic air bag reaches a level at which the pressurized air in the air bag counteracts the liquid pressure within the liquid bag and as the inflating of the air bag continues up to the weld line, the air being forced around the sides of the air bag causing the air bag to push into corners of the air bag which in turn forces the liquid in the liquid bag from the corner toward the middle of the liquid bag and then as the liquid gets down low enough, the air in the air bag then forces underneath of the liquid in the liquid bag and lift the liquid in the middle up so that all the remaining liquid can be drained out from the liquid bag.

A further aspect of the present invention is directed to a system for fully dispensing liquid or semi-liquid bulk material from a bulk shipping container. The system comprises a tote or a bulk bin having a dispensing opening. A cassette board tray is configured to be disposed into the tote or the bulk bin. The cassette board tray comprises a liquid bag and an air bag each of which made of plastic material and adhesively attached to one another. The liquid bag includes an inlet port for receiving the liquid bulk material and an outlet port for dispensing the liquid bulk material from the liquid bag. The outlet port of the liquid bag is inserted into the dispensing opening. The air bag includes an air inlet port that is formed at one end thereof and is used for inflating the air bag from a source of pressurized air. The air bag further includes an obstruction region defined by a weld line that is formed on an opposite end from the air inlet port to redirect the pressurized air within the air bag. Upon inflating the air bag reaches a level at which the pressurized air counteract the liquid pressure within the liquid bag so as to urge the liquid toward the dispensing outlet valve of the liquid bag.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE INVENTION

Figure 1:
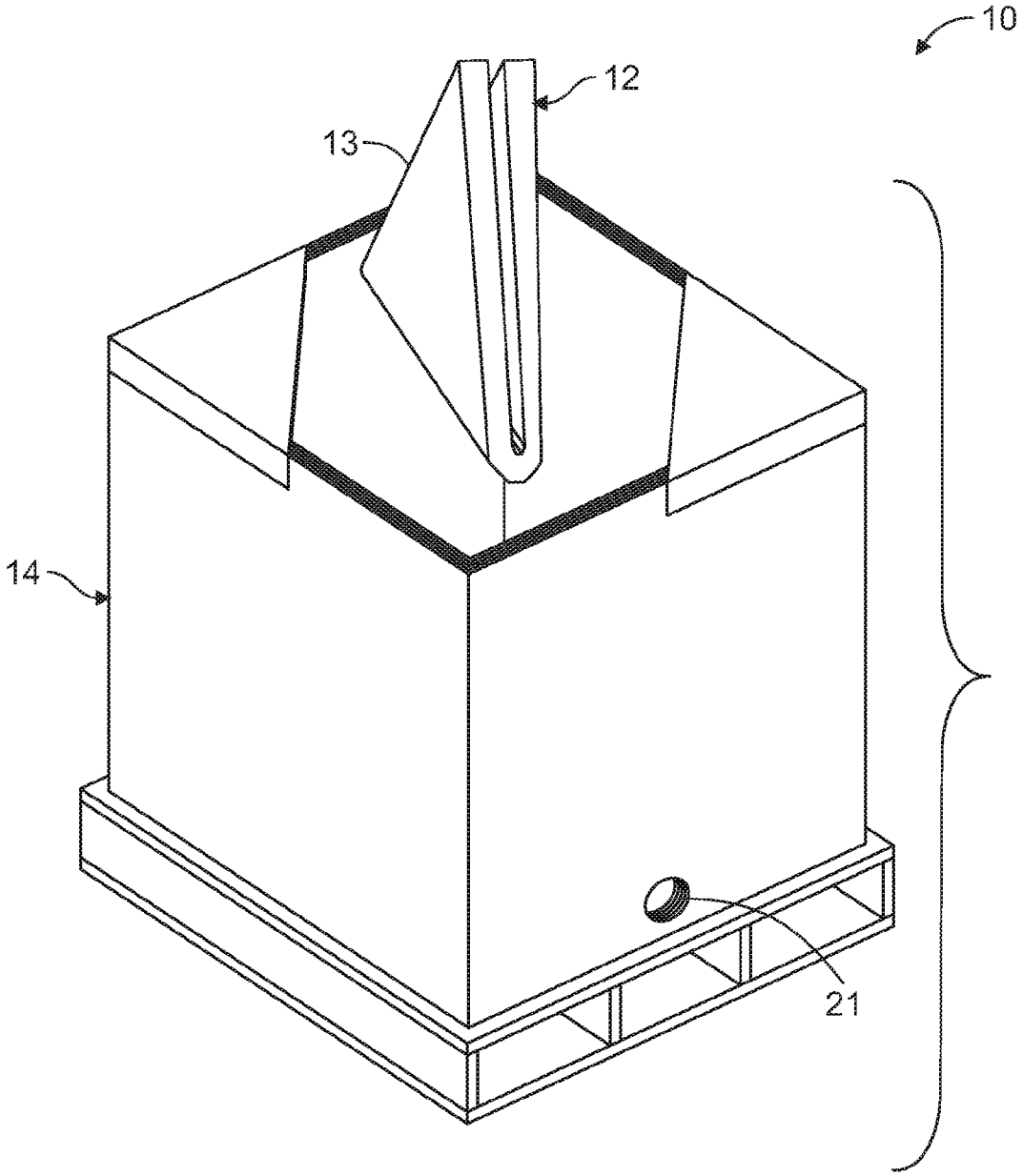
FIG. 1 is an exploded perspective view of an assembled tote and a cassette supported on a pallet in which the cassette is defined by a cassette board that contains a product bag, an inflated air bag, and inlet and out ports or valves all of which concealed therein in a knock down position.

While this invention is susceptible of embodiment in many different forms, there is shown, in the drawings, several specific embodiments with the understanding that the present disclosure is to be considered as an exemplification of the principles of the invention and is not intended to limit the invention to the embodiments illustrated. It will be understood that like or analogous elements and/or components, referred to herein, are identified throughout the drawings by like reference characters. In addition, it will be understood that the drawings are merely representations of the present invention, and some of the components may have been distorted from actual scale for purposes of pictorial clarity.

FIG. 1 is a top perspective view of an intermediate bulk container (IBC) 10 having an assembled bin or tote 14 and a cassette 12 positioned in a space relationship with the tote or bin. The cassette 12 is defined by a foldable cassette board 13 that contains a first flexible bag defined as a product bag 16, a second flexible bag defined as an inflated air bag 18, and associated inlet and out ports or valves 20, 22 in a knock down position. The product bag 16, the inflated air bag 18, and the inlet and out ports or valves are concealed within the foldable cassette board tray 13. The product bag 16 is a three ply plastic bag and the air inflated bag 18 is a two ply plastic bag, but one of skilled in art would appreciate that the respective bags can be constructed from various numbers of plies. The circular opening 21 near the bottom of the bin or tote 14 is used to receive the outlet port or a dispensing valve. In use, the cassette 12 is disposed on the floor or bottom of the tote 14 and then is unfolded so that the product bag 16 is filled with liquid or semi-liquid material while the air inflated bag 18 is attached thereto as will be described in greater detail hereinafter. The cassette board tray 13 is made of corrugated paperboard, but one of skilled in art would appreciate that the cassette board can be made of other material such as plastic as well.

Figure 2:
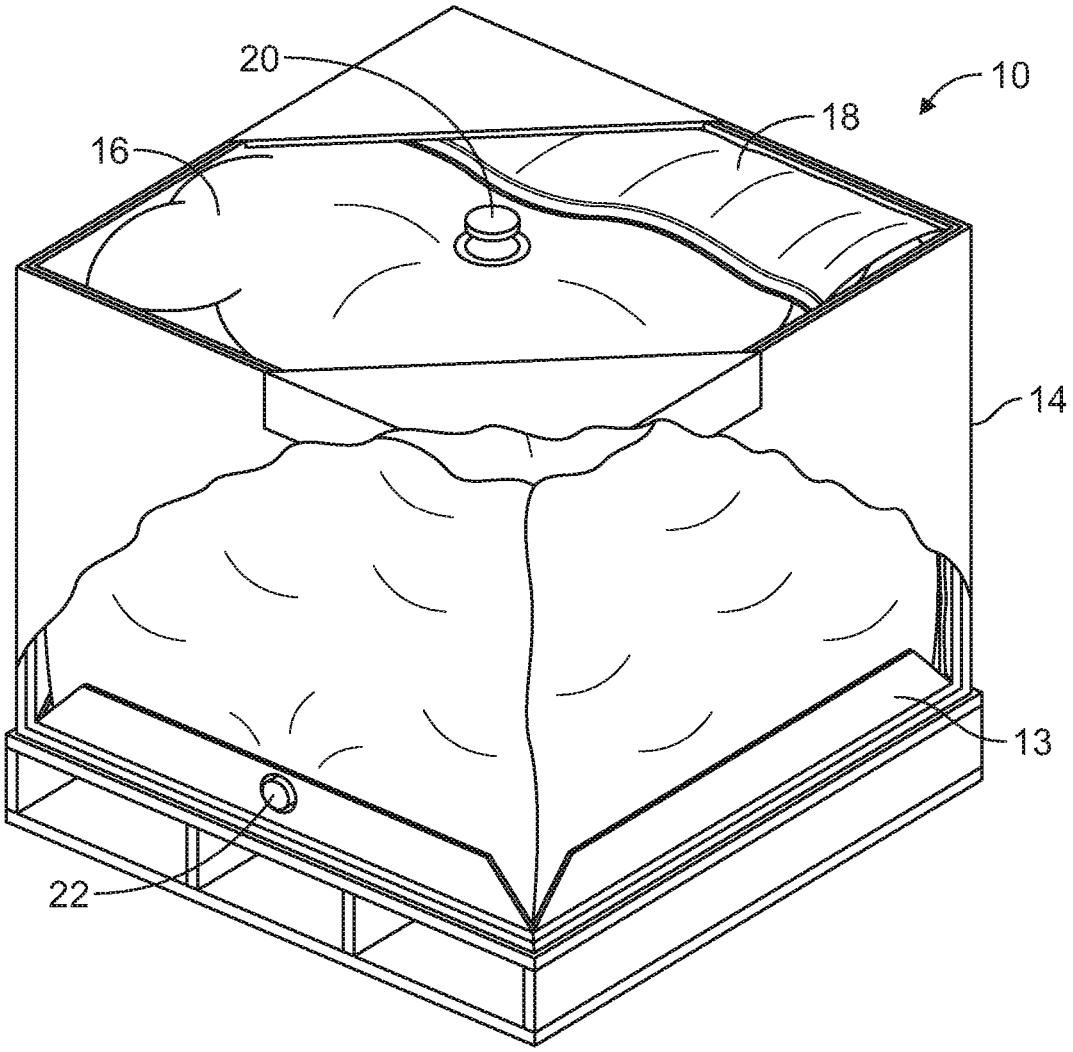
FIG. 2 is a top perspective view of a partially cut away portion of tote to expose inside of the tote with the cassette board positioned on the bottom of the tote with the product bag containing liquid material, an inflated air bag, and inlet and outlet valves apparatus in accordance to the preferred embodiment of the invention.
Figure 3:
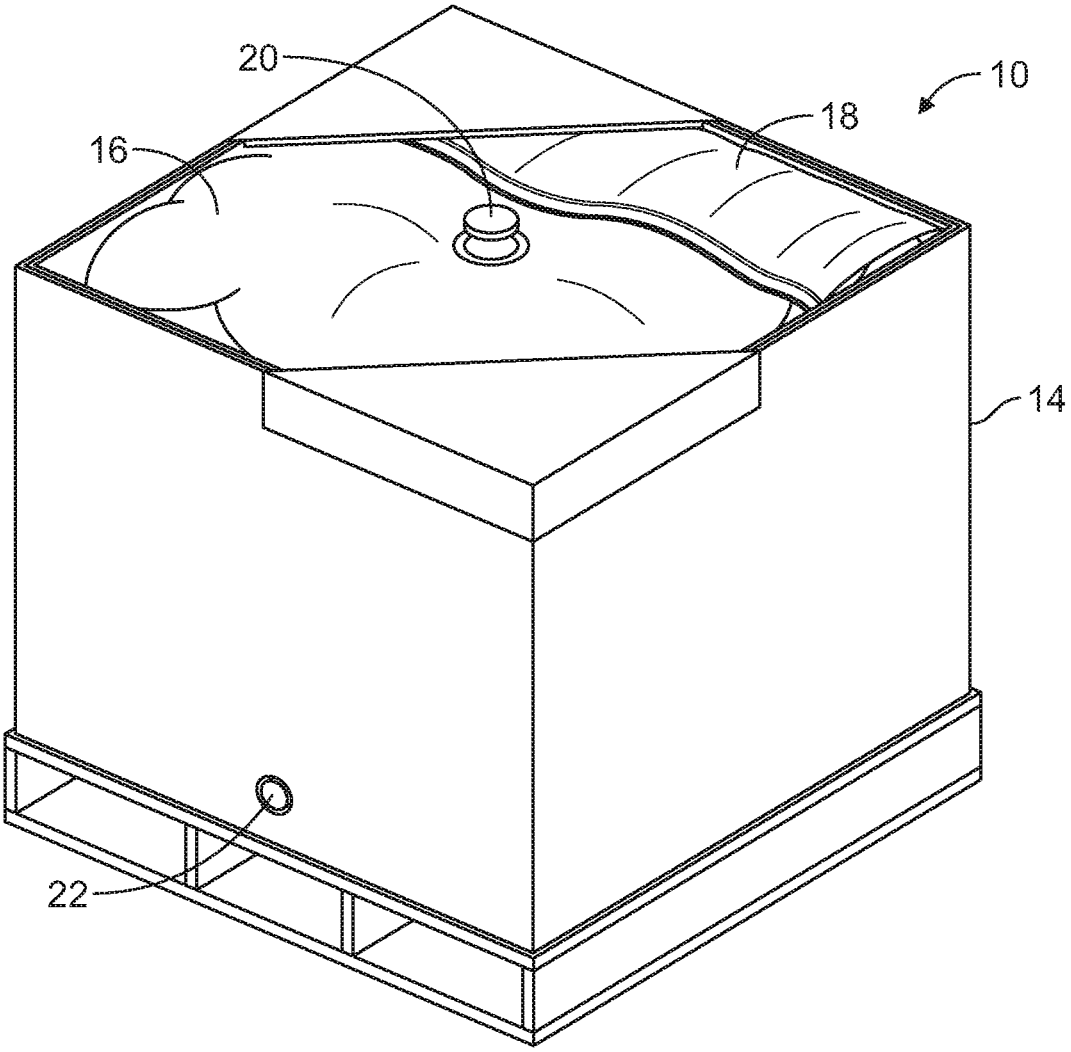
FIG. 3 is similar to FIG. 2 illustrating the relative position of the product bag and the inflated air bag with respect to one another.

FIG. 2 is a top perspective view of a partially cut away portion of tote to expose inside of the tote 14 with the cassette board tray 13 positioned on the bottom of the tote with the product bag 16 containing liquid or semi-liquid material, an inflated air bag 18, and inlet and outlet valves 20, 22 apparatus in accordance to the preferred embodiment of the invention and FIG. 3 is similar to FIG. 2 illustrating the relative position of the product bag 16 and the inflated air bag 18 with respect to one another. The intermediate bulk container 10 is defined by a bag and box combination receiving a dispensing apparatus 22 in accordance to the preferred embodiment of the invention. The bag and box combination is comprised of a rigid bulk bin or tote 14 and a product bag 16 made of suitable flexible material such as plastic. One particularly suitable container for forming the rigid bulk bin or tote 14 is sold by International Paper Company under the trademark SpaceKraft® as seen best in FIG. 3. The tote or bulk bin 14 is made from a continuously wound sleeve of linerboard and corrugated paperboard medium to create a package that is six to ten layers thick with no seam. This seamless construction has no manufacturing joint which offers extraordinary strength-up to 75,000 pounds of top-to-bottom compression strength without wood or metal components. However, one of ordinary skilled in the art would appreciate that the invention may also be used with other outer rigid bulk bin or tote. The product bag 16 is made of low density food grade polyethylene that can operate effectively from −20° C. to more than +40° C. The plastic product bag 16 is supported inside the tote or bulk bin 14 for containing liquids or semi-liquid fluids. When filling the product bag 16 with a liquid, a filling valve is attached to its upper end inlet port to pour in liquid and then the product bag 16 is sealed with a removable cap. During dispensing the liquid from the plastic bag 16, the dispensing fitment plug is removed and a dispensing apparatus is attached thereto to dispense the liquid from the outlet port of the product bag 16.

Figure 11:
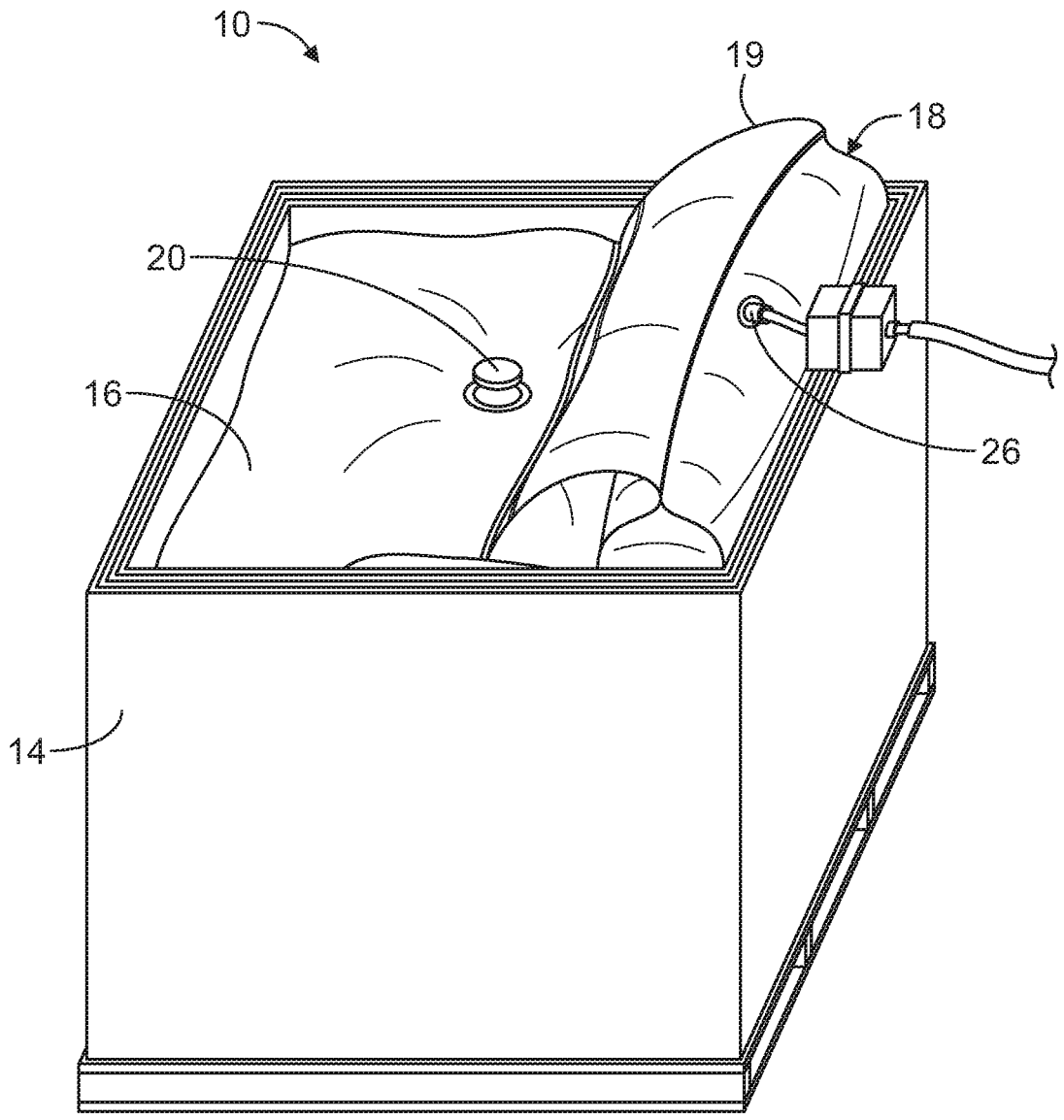
FIGS. 11 and 12 illustrate a partially evacuated material from product bag with the air inflated bag used to completely dispensing the liquid material from the product bag.
Figure 12:
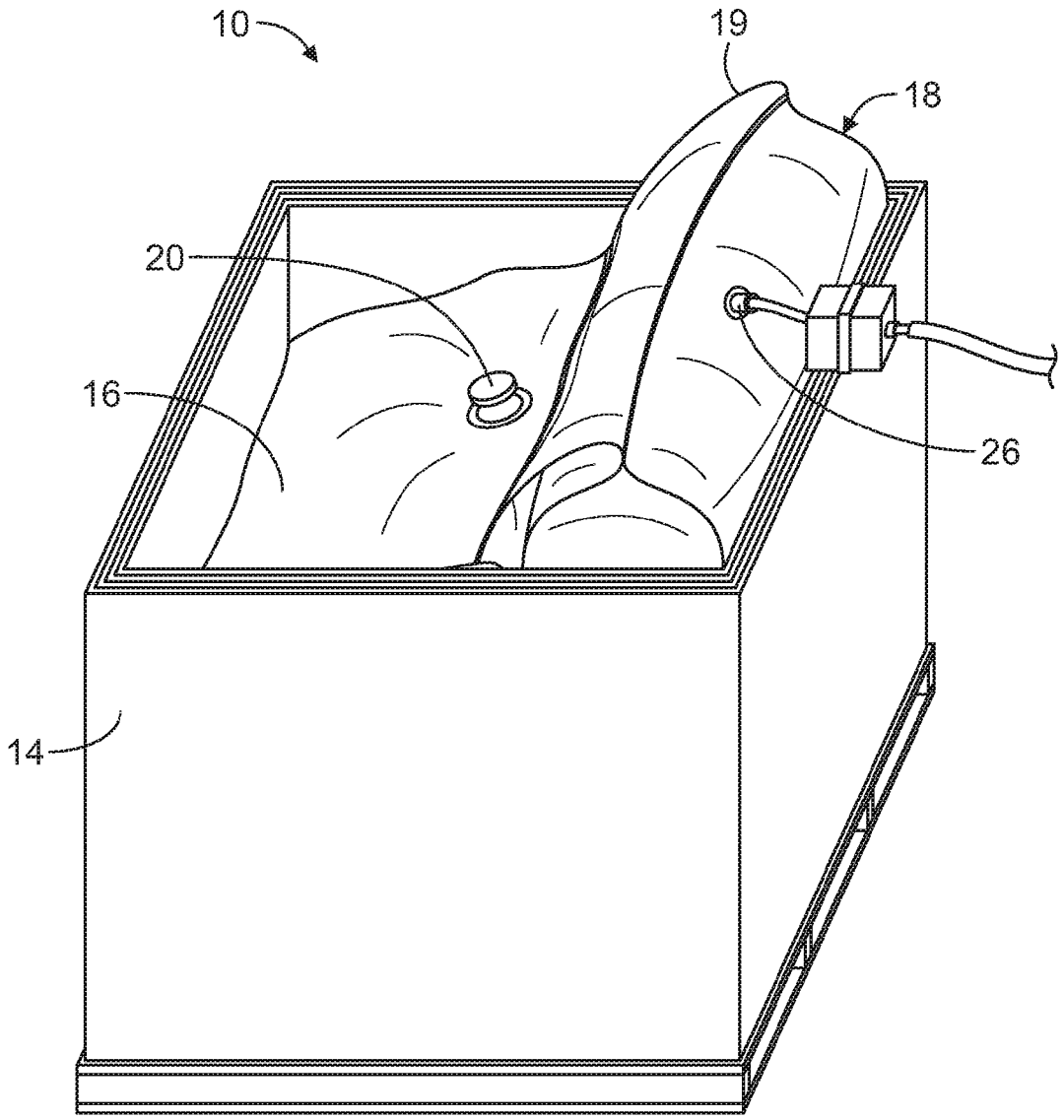
Figure 13A:
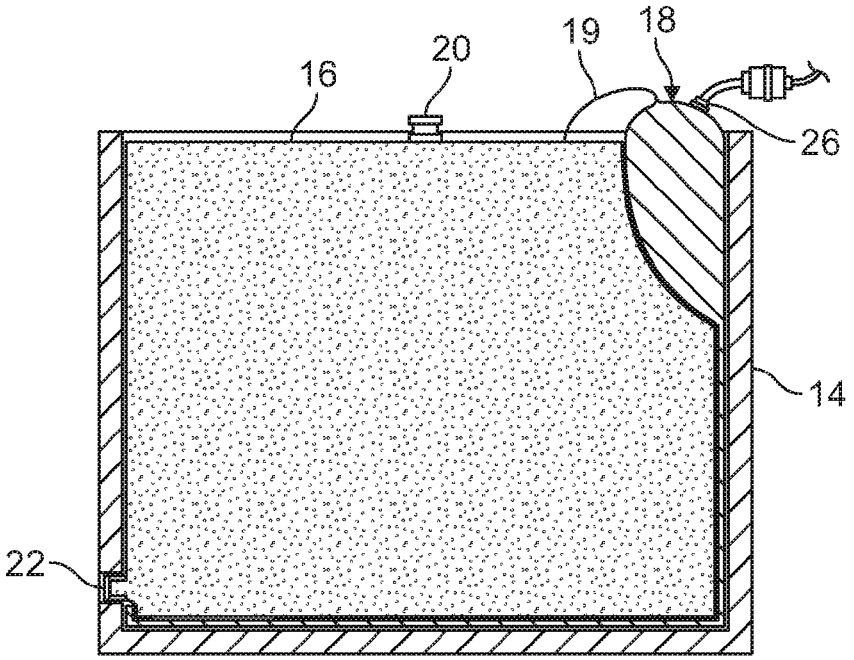
FIGS. 13A-13G illustrate the manner in which the air inflated bag is used to completely withdraw the liquid material from the product bag.
Figure 13B:
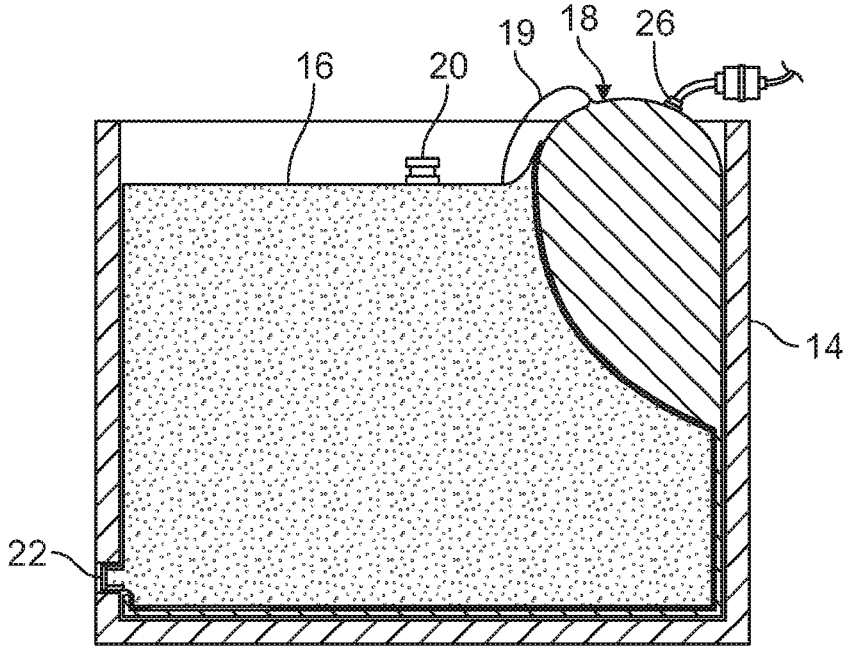
Figure 13C:
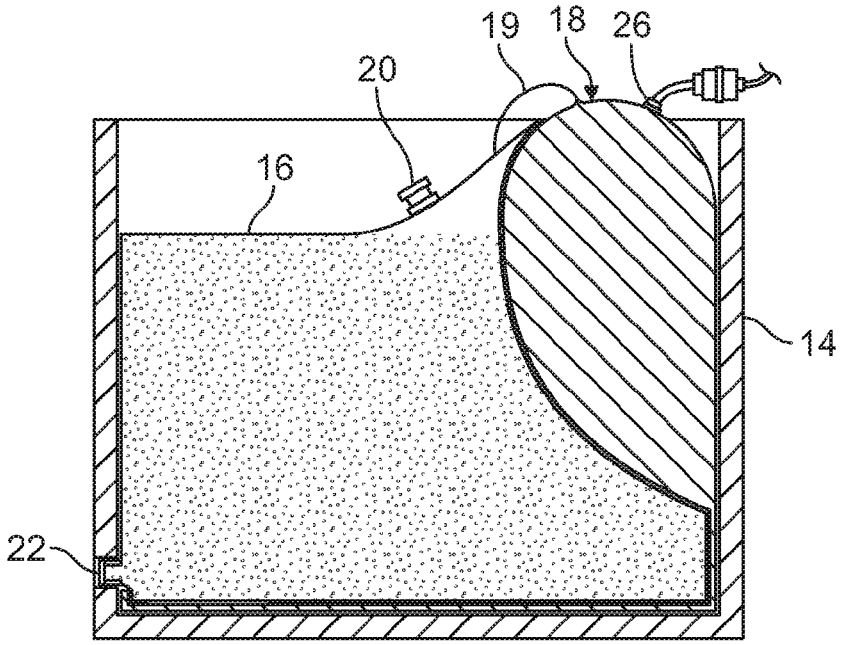
Figure 13D:
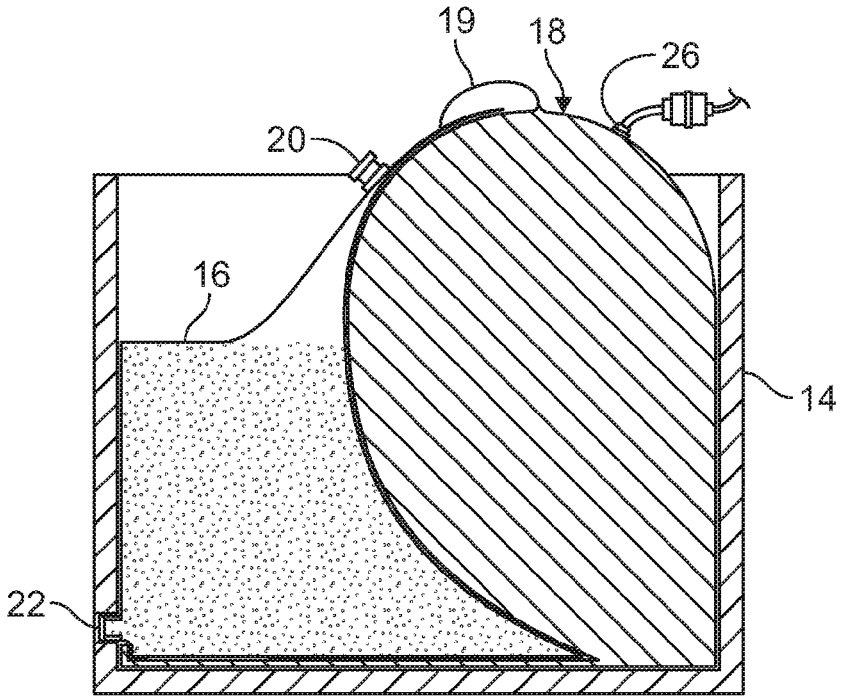
Figure 13E:
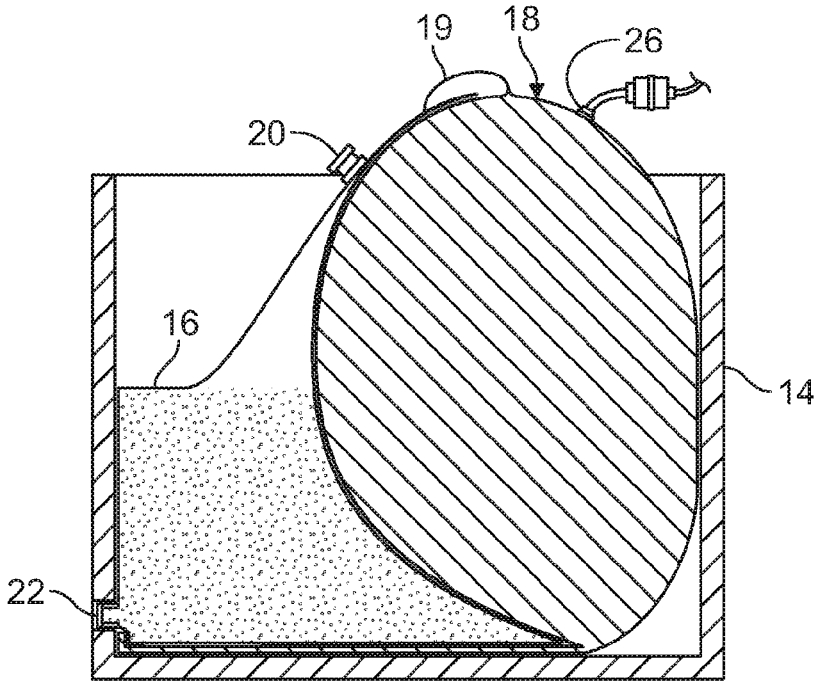
Figure 13F:
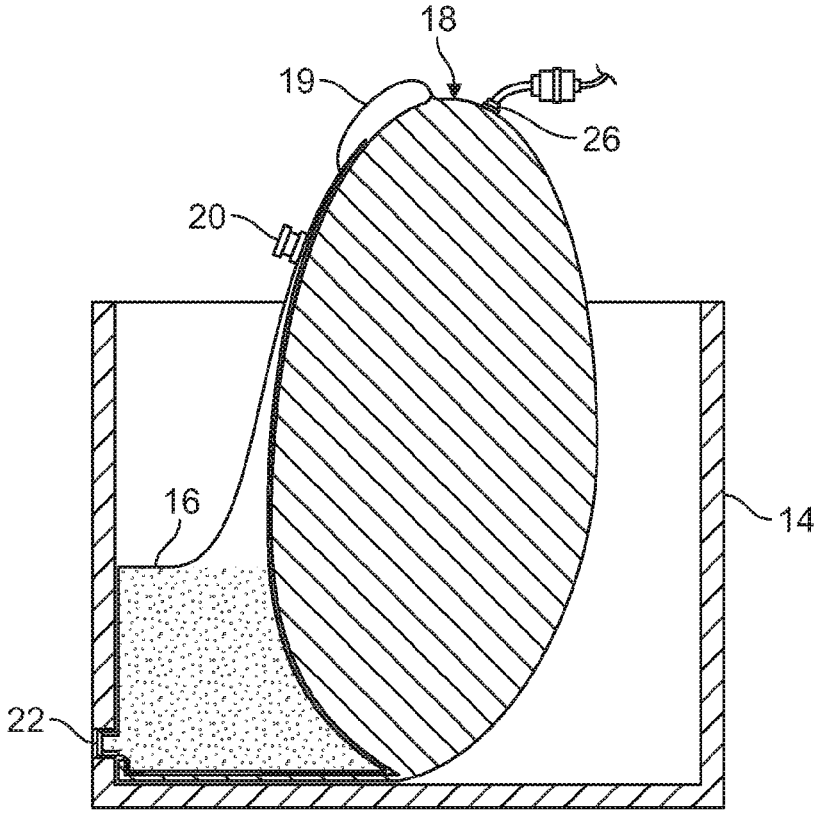
Figure 13G:
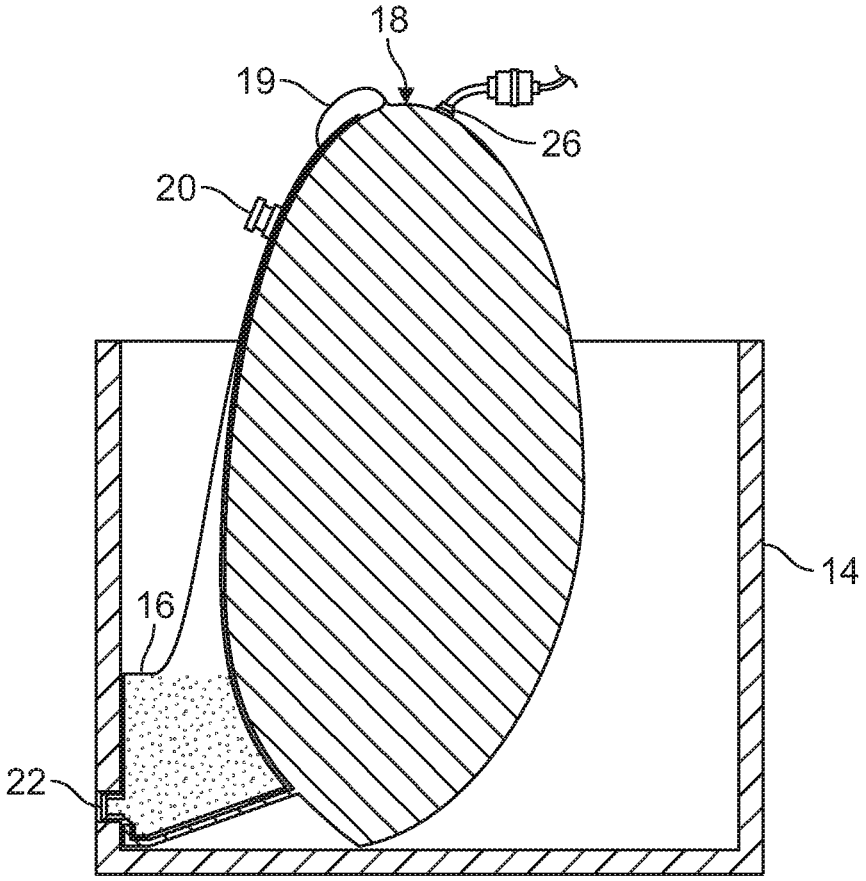
Figure 14A:
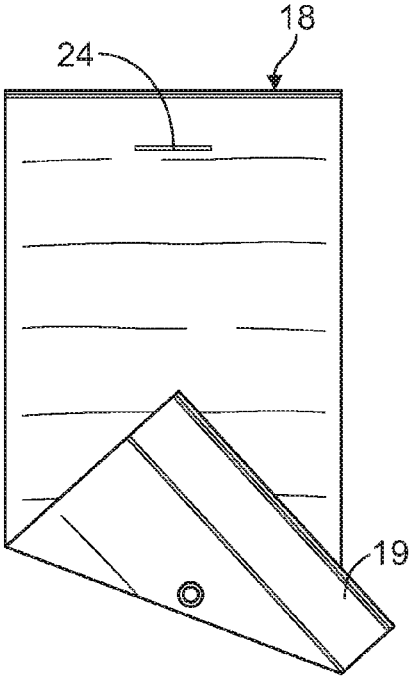
FIGS. 14A-14D illustrate the various weld configurations that are formed on the air inflated bag.
Figure 14B:
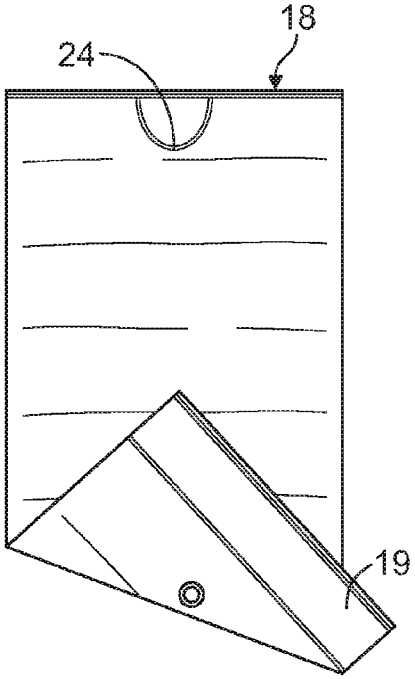
Figure 14C:
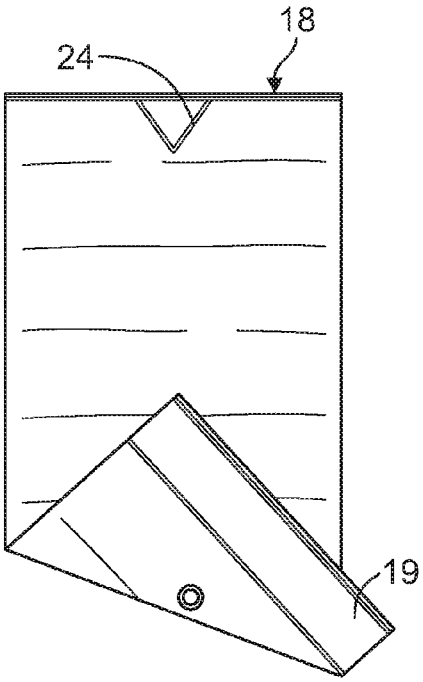
Figure 14D:
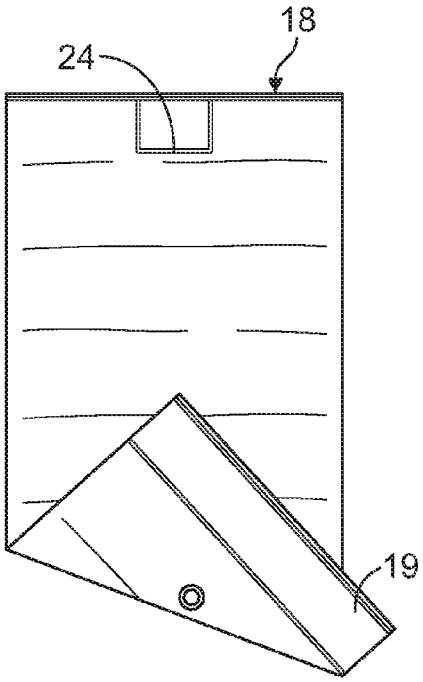

The SpaceKraft™ container, for example, has a number of customers who package products that are viscous or sticky and thus, don't flow easily or they cling to the product bag 16 when being dispensed. The result is more residual product left in the product bag 16 which becomes expensive waste and a disposal issue. The present invention solves this problem by using a separate air inflated bag 18 or pillow plastic bag and tape it to the product bag 16. A double sided tape to attach the two bags 16 and 18 to one another and to the cassette board 13 and this tape adheres very well to both the product bag 16 and the air inflated bag 18. It should be noted that the two plastic bags 16 and 18 are taped together rather than welding them together. The taping would allow a much cheaper process and a more flexible product offering so that the plastic bags 16 and 18 could be made on demand. The air inflated bag 18 functions by inflating the air bag 18 from a source of pressurized air (not shown) at the top of the container 14 starting at the back of the container opposite to the outlet valve 22 as depicted in FIG. 11. As the air bag 18 inflates from a source of pressurized air it forces the product inside the product bag 16 moves forward towards the side of the container 10 where the dispensing fitment or the outlet valve 22 is located. As the dispensing of the product continues and the level of the product in the bag gets low enough, the air inside the air bag starts to force its way across the bottom of the container 14 towards the outlet valve 22 as illustrated in FIGS. 13A-13G. Since the air inflated bag 18 resembles a pillow bag, it inflates in a round manner which forces the product in the middle of the container 14 to the dispense outlet valve 22 faster than the product along the sides of the product bag 16. Eventually, it forces its way across far enough that it forces the product bag 16 to cover up the dispense outlet trapping product in the front corners of the product bag.

Figure 4:
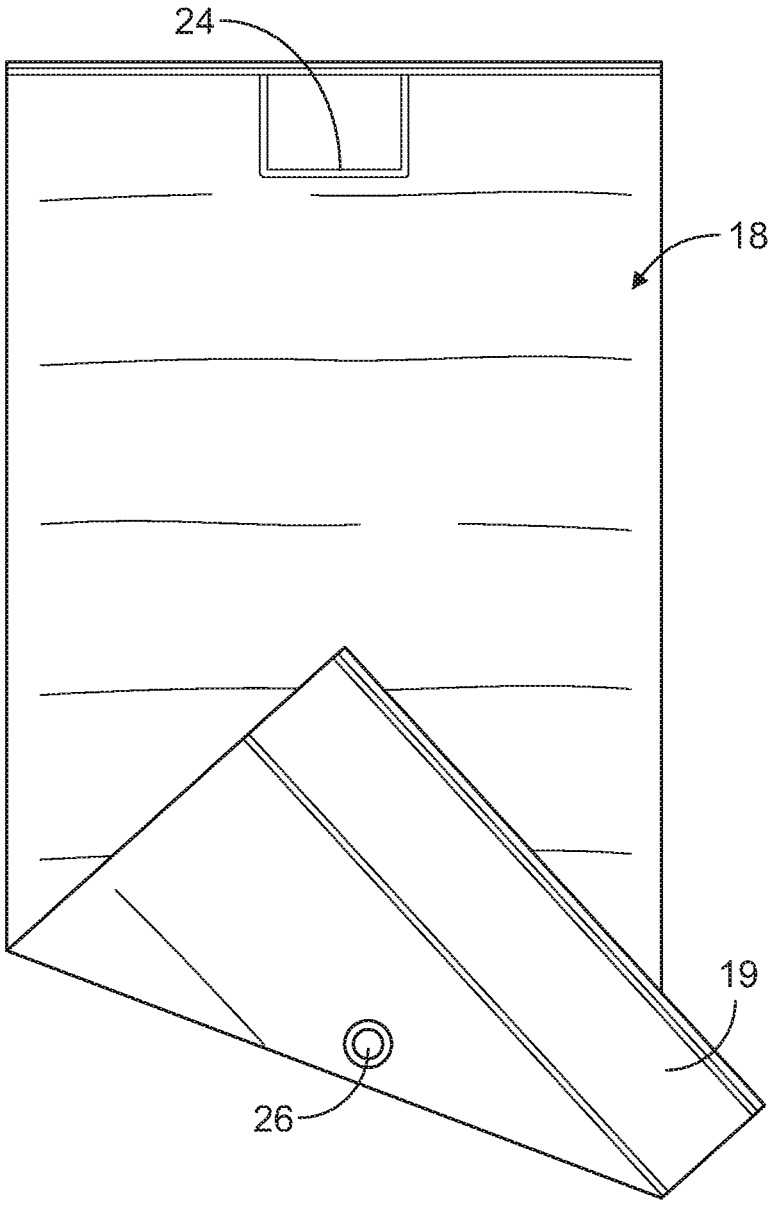
FIG. 4 is a top view of the air inflated bag having a weld line and wherein a portion of bag is flipped to depict an air inlet opening with the weld line formed on an opposed side of the air inlet opening.
Figure 5:
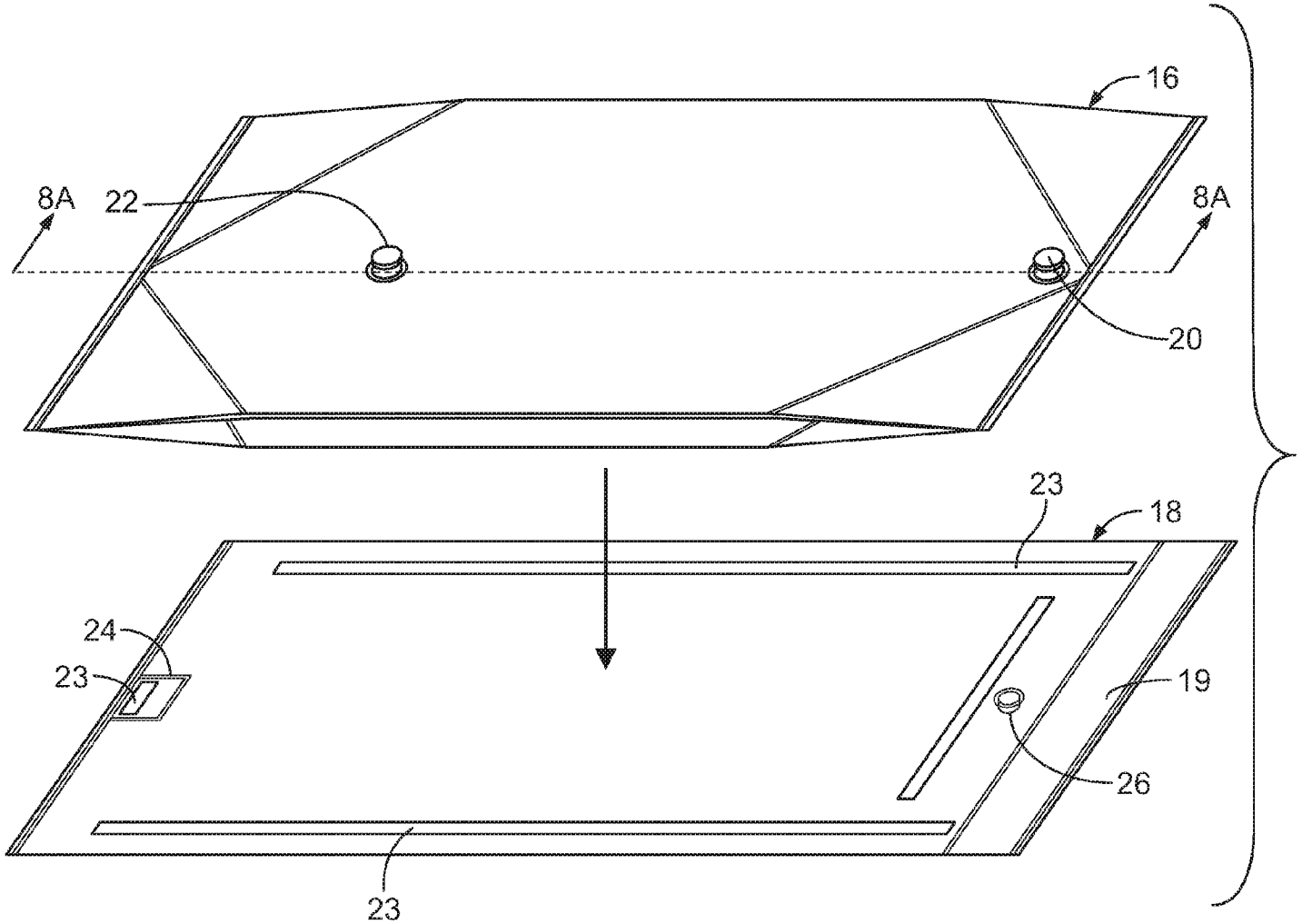
FIG. 5 depicts the product bag and the air inflated bag in a space relationship with one another and illustrates the manner in which the product bag is laid over the air inflated bag and attached thereto.
Figure 6:
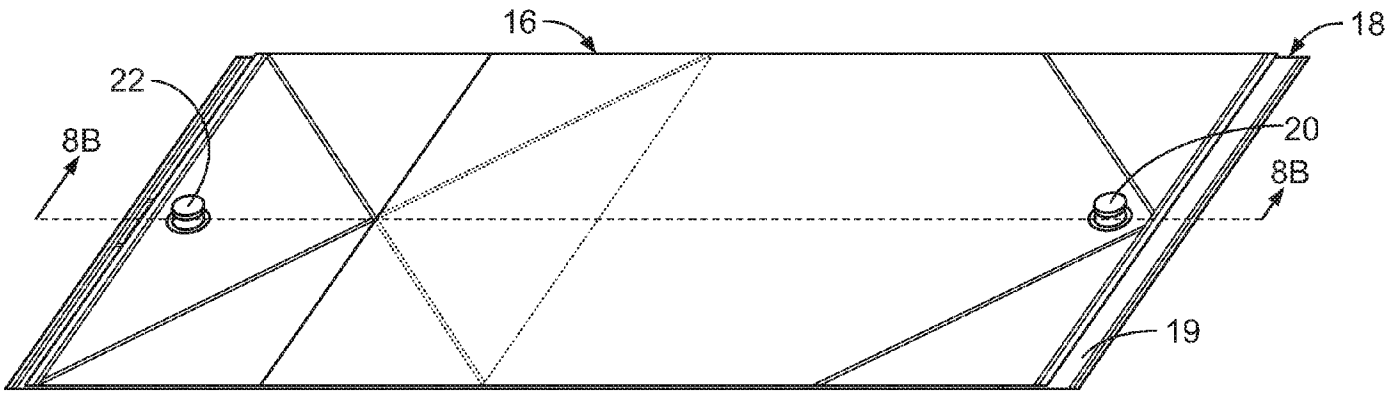
FIG. 6 is similar to FIG. 5 which shows the product bag is adhesively attached to the air inflated bag.
Figure 7:
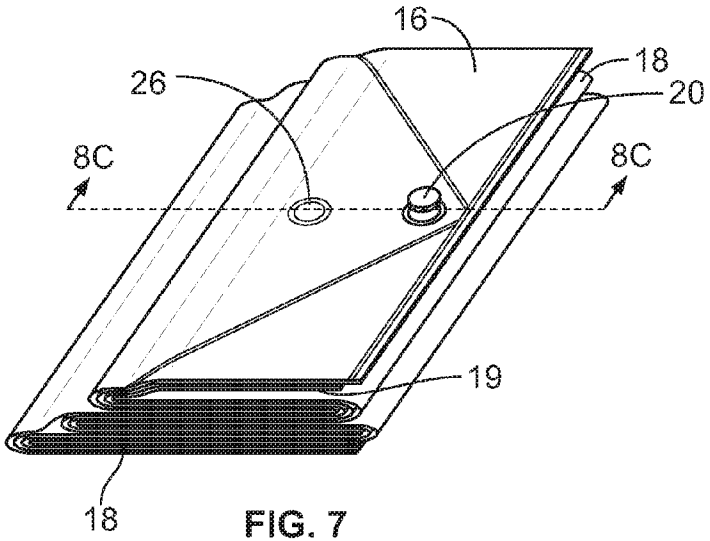
FIG. 7 depicts the manner in which the product bag and the air inflated bag are folded onto one another.
Figure 8A:
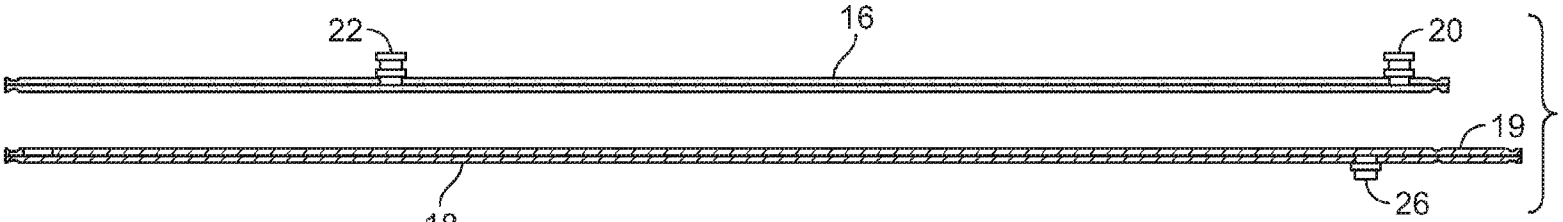
FIGS. 8A-8C illustrates a respective sectional view of the respective FIGS. 5-7.
Figure 8B:
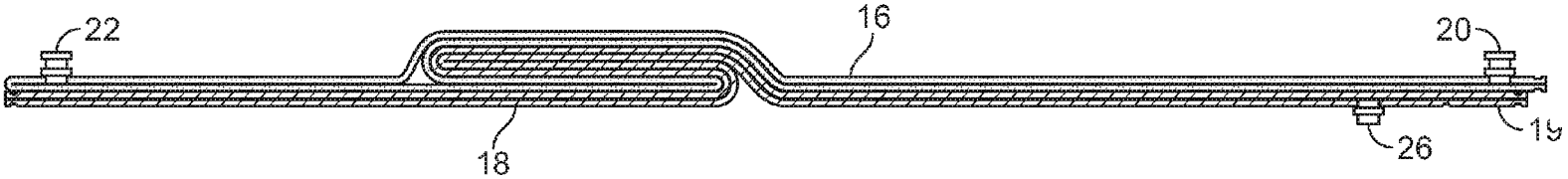
Figure 8C:
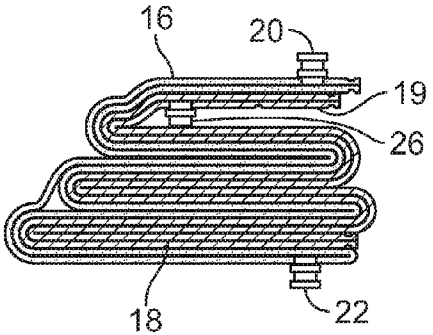
Figure 9:
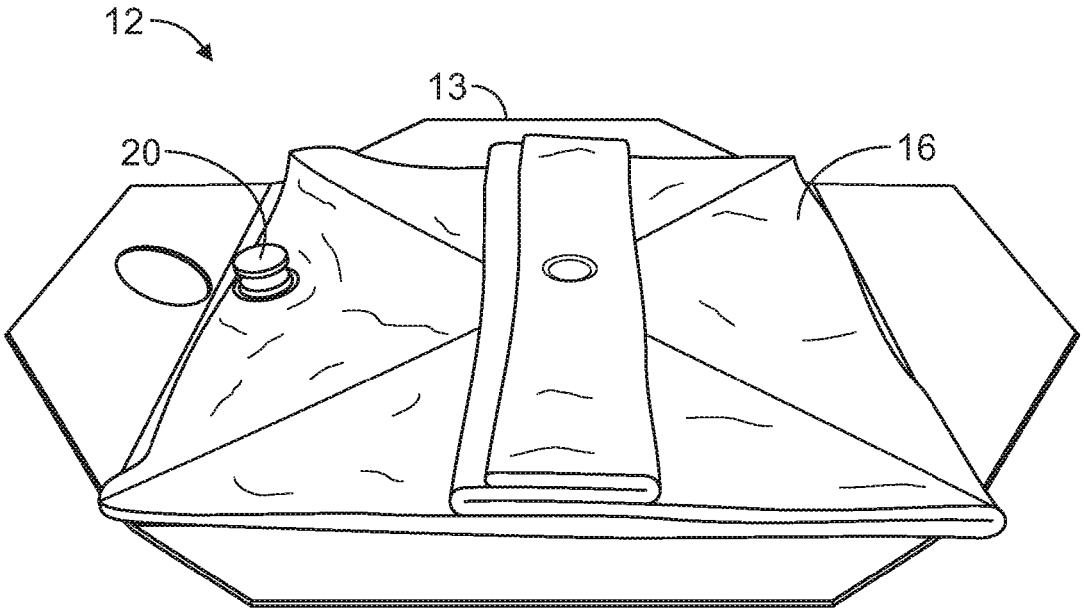
FIG. 9 illustrates a cassette board containing the product bag and the air inflated bag in a partially unfolded position.
Figure 10:
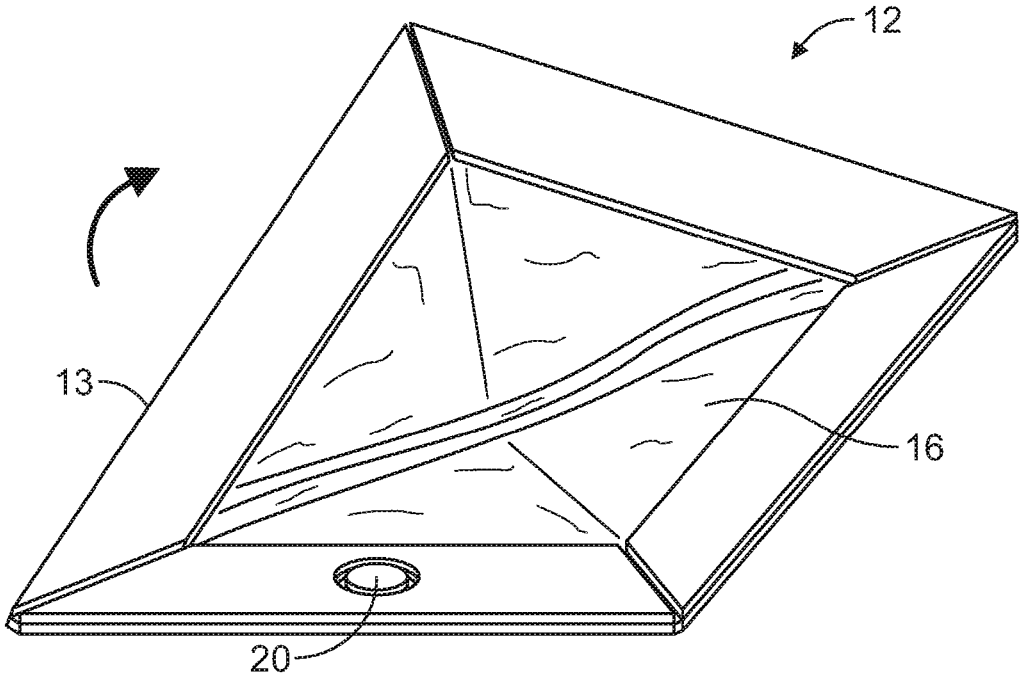
FIG. 10 depicts the cassette board, product bag, and the air inflated bag in a position to be fully folded as illustrated in FIG. 1.

Referring generally to FIGS. 4-7 and particularly to FIG. 4, which is a top view of the air inflated bag 18 having a weld line 24 and wherein a portion of the air bag 18 is flipped to depict an air inlet opening 26 formed on one end of the air inflated bag 16 with the weld line 24 formed on the opposed end of the bag. Similar to the product bag 16, the air inflated bag 18 is made of a low density polyethylene. The air inflated bag 16 includes a flap 19 integrally attached to one end of the air bag. The flap 19 is adhesively attached to the product bag 16 so that during the dispensing of the product, the product bag does not collapse into bin which may impede the complete evacuation of the product from the product bag 16. The air inflated bag 18 is made of a two-ply plastic film that is sealed around its perimeter. The weld line 24 is formed by joining the two-ply of the air bag at that location by the simultaneous application of heat and pressure. The formation, location and configuration of the weld line 24 onto the air bag 18 is important since the weld line 24 would prevent the expansion of the air bag 18 from reaching the dispensing outlet valve 22. When the air bag 18 is inflated up to this weld line 24, the air was forced around the sides of the air bag 18 causing the air bag to push into the corners of the air bag which, in turn, forces the product inside the product bag 16 towards the middle and the dispensing outlet valve 22. Eventually the air fills up the air inflated bag 18 underneath the product bag 16 which lifts the product bag up to the dispensing outlet valve or port so as to fully or completely evacuate the product bag 16. In the preferred embodiment of the invention, the weld configuration 24 is in rectangular shape, but one of skilled in the art would appreciate that the weld configuration can be, among others, semi-circular, a straight line, and/or a triangular shape as seen best in FIGS. 14A-14D. As shown in FIG. 5, to attach the product bag 16 to the air inflated bag 18, a double sided tape 23 is used so that the product bag 16 is laid over the air inflated bag 18 and is attached thereto as seen best in FIG. 6. It should be noted that outlet valve 22 of the product bag 16 and the weld line 24 of the air inflated bag 18 are on the same side when the two bags are attached to one another. After the two bags 16 and 18 are attached to one another, they are folded onto one another as depicted in FIG. 7. It should be noted that the product bag 16 and the air bag 18 are sized and constructed in a manner so that when the two bags are folded together they correspond to the size of the cassette board tray 13, which in turn, they correspond to the size of the tote or bulk bin 14. The relative thickness and the height of each of the respective product bag 16 and the air bag 18 with respect to one another as well as when they attached and folded to one another is illustrated in FIGS. 8A-8C. Finally, the two plastic bags 16 and 18 in a tandem arrangement are attached to the cassette board tray 13 as seen best in FIGS. 9 and 10. As illustrated in FIG. 1, the cassette 12 is disposed inside the tote 14 which holds the two bags 16, 18 and the inlet valve 20 in place and properly aligns the dispense outlet or outlet valve 22 with the corresponding opening 21 formed on the tote. Then through the inlet valve 20, the product bag 16 is filled with liquid or semi-liquid material and then using a corrugated cap (not shown) to enclose the tote, the intermediate bulk container 10 is shipped to the end users. The intermediate bulk container 10, such as a SpaceKraft® container, is used for wide range of food and industrial chemical products and is designed for both domestic and export shipments. The intermediate bulk container 10 arrives at the customer or user facilities in one of two ways: it is either knocked down flat or, alternatively, set-up and ready to fill. One of the advantages of the intermediate bulk container 10 and the associated cassette 12 is that each of these two items can be re-used and they can be obtained separately. For example, sometimes a number of cassettes, for example 24 cassettes, are stacked on one another, packaged and shipped to various customers of such containers.

FIGS. 13A through 13G illustrate the manner in which the air inflated bag 18 is used to completely withdraw the liquid material from the product bag 16. The product bag 16 and the air inflated bag 18 are attached to the cassette board 13. The product bag 16 that contains the product resemble generally a three dimensional cube. The air inflated bag 18 which resembles a pillow bag is laying under the bottom of the product bag 16 and up the back side of the container 14 so it forms an L-shaped under the bottom up the back side of the container. Therefore, when inflating the air inflated bag 18, the air bag starts pressing the product from the back side toward the front side as seen best in FIG. 13B. As the liquid level goes down in the product bag 16 and the pressure from the weight of the liquid goes down, the air pressure of the air bag 18 overcomes the weight of the liquid and pushes the liquid forward as depicted in FIG. 9B. Initially, the air bag 18 pushes forward at the top and then eventually it starts pushing forward at the bottom as depicted in FIGS. 9C and 9D. One advantage of the claimed invention over the prior art is that in the claimed invention, the product bag 16 and the air bag 18 are taped together as oppose to all the prior art bags that are welded together. Therefore with the prior art bags, the product is pushed forward with this a two dimensional bag that is inflated, the inflated bag forms an oval shaped cross section, it gets rounded and it pushes forward faster in the middle than it is in the side and eventually it pushes all the way up against the front edge of the container and yet it is rounded in the corners so product traps in the corners. It should be emphasized that with the prior art bags, these bags push the product from the back to the front all the way across the bottom, all the way to the front side and they close off the dispense fitment or outlet valve and cause to trap product in the corner.

To overcome the shortcoming of the prior art bags, the claimed invention applies a weld configuration 24 across the middle portion of the air inflated bag 18 away from the outlet valve 22 to prevent the air bag 18 from pressing against front panel down low at the bottom where the dispense fitment or outlet valve 22 is located. So up higher, it compresses all the way against the front panel, but it creates a pocket where it does not close off the orifice of the outlet valve or dispense fitment and it continues to inflate since it cannot push pass that weld configuration 24. It then pushes around the weld 24 on the side and it starts pushing the product from the corner toward the middle and then as the product gets down low enough, the air then forces underneath of the product and lift the product in the middle up so that all the remaining product can drain out from the outlet valve or dispense fitment 22. The black line 24 in the air inflated bag 18 represent the weld configuration 24 that welded together the top two plies or layers to the bottom two plies layers to prevent the air from inflating all the way to the edge of the air bag 18. The weld is applied in the middle back about 1 ft or so from the front to prevent it from inflating all the way to the front of the container and closing off the outlet valve or dispense fitment 22. The air inflated bag 18 is taped underneath the floor of the product bag 16 and up the back side of the product bag 16. The air bag 18 is taped to the corrugated cassette board 13 which is laid beneath the product bag 16 as described hereinbefore. The manner in which these two bags 16 and 18 are attached one another or to the cassette board 13 is not limited to taping them together. It is within the scope of the claimed invention that these two bags 16 and 18 and the cassette board 13 being engaged with one another without even physically being attached to one another.

FIGS. 14A-14D illustrate the various weld configurations 24 that are formed on the air inflated bag 18. One of the important aspects of the claimed invention is that the weld configurations 24 prevents the air from pushing off and closing the dispense fitment and that the weld geometry itself can be straight line or it could be angled, semi-circular, V-shaped, or rectangular and the likes.

In use, the product bag 16 is filled with liquid or semi-liquid product and then the container is closed at its upper end. The filled container is now ready to be used or even shipped to a second customer who will dispense and use the product. This is accomplished by placing a conventional valve spigot on the outlet valve 22 and proceeds with dispensing the product bag contents as described in detail and illustrated with respect to FIGS. 13A through 13G.

While various features are presented above, it should be understood that the features may be used singly or in any combination thereof. Further, it should be understood that variations and modifications may occur to those skilled in the art to which the claimed examples pertain. The examples described herein are exemplary. The disclosure may enable those skilled in the art to make and use alternative designs having alternative elements that likewise correspond to the elements recited in the claims. The intended scope may thus include other examples that do not differ or that insubstantially differ from the literal language of the claims. The scope of the disclosure is accordingly defined as set forth in the appended claims.

What is claimed is:

1. A system for fully dispensing flowable bulk material from a bulk shipping container, the system comprising:

a tote or a bulk bin having a dispensing opening;

a first flexible bag being disposed inside the bulk bin, the first flexible bag includes an inlet port for receiving the flowable bulk material and an outlet port for dispensing the flowable bulk material from the first flexible bag, the outlet port of the first flexible bag being inserted into the dispensing opening; and a second flexible bag being removably attached to the first flexible bag, the second flexible bag includes an air inlet port being formed at one end thereof and used for inflating the second flexible bag from a source of pressurized air, the second flexible bag further includes an obstruction region defined by a weld line that is formed on an opposite end from the air inlet port to redirect the pressurized air within the second flexible bag wherein upon inflating the second flexible bag reaches a level at which the pressurized air counteract a flowable material pressure within the first flexible bag so as to urge the flowable bulk material toward the outlet port of the first flexible bag.

2. The system of claim 1 wherein the first and second flexible bags are removably attached to a cassette board tray and concealed therein wherein the cassette board has a size and a shape corresponding to a size and a shape of the tote or bulk bin.

3. The system of claim 1 wherein the first flexible bag is a product bag containing liquid or semi-liquid material.

4. The system of claim 3 wherein the product bag is constructed from a plastic made of low density food grade polyethylene that can operate effectively from −20° C. to more than +40° C.

5. The system of claim 1 wherein the second flexible bag is an air bag constructed from a two ply plastic.

6. The system of claim 1 wherein the first and second flexible bags are adhesively attached to one another by a double sided tape.

7. The system of claim 1 wherein the weld line on the air bag is generally a rectangular in shape.

8. The system of claim 1 wherein the weld line on the air bag is generally a semi-circular in shape.

9. The system of claim 1 wherein the weld line on the air bag is generally a triangular in shape.

10. The system of claim 1 wherein the weld line on the air bag is generally a straight line in shape.

11. The system of claim 1 wherein the weld line is formed by joining a portion of a two ply plastic film together at that location by simultaneous application of heat and pressure.

12. A method of fully dispensing liquid or semi-liquid material from a plastic liquid bag having a middle and corners contained in a bulk container, the method comprising the steps of:

attaching a plastic air bag to the plastic liquid bag wherein the plastic air bag includes a plurality of sides an air inlet port formed at one end and an obstruction region defined by a weld line formed on an opposite end thereof; and connecting the air inlet port to a source of pressurized air for inflating the plastic air bag wherein inflating the plastic air bag reaches a level at which the pressurized air in the air bag counteracts a liquid pressure within the liquid bag and as the inflating of the air bag continues up to the weld line, the air being forced around the sides of the air bag causing the air bag to push into the corners of the liquid bag which in turn forces the liquid material in the liquid bag from the corners toward the middle of the liquid bag and then as the liquid material gets down low enough, the air in the air bag then forces underneath of the liquid material in the liquid bag and lift the liquid material in the middle so that all the remaining liquid material can be drained out from the liquid bag.

13. The method of claim 12 wherein the step of attaching the plastic air bag to the plastic liquid bag includes using a cassette board tray to receive the air bag and the liquid bag after being attached to one another and before being disposed into the bulk container.

14. A system for fully dispensing liquid or semi-liquid bulk material from a bulk shipping container, the system comprising:

a tote or a bulk bin having a dispensing opening; and a cassette board tray configured to be disposed into the tote or the bulk bin, the cassette board tray comprises a liquid bag and an air bag each of which made of plastic material and adhesively attached to one another, the liquid bag includes an inlet port for receiving the liquid bulk material and an outlet port for dispensing the liquid bulk material from the liquid bag, the outlet port of the liquid bag being inserted into the dispensing opening, the air bag includes an air inlet port being formed at one end thereof and used for inflating the air bag from a source of pressurized air, the air bag further includes an obstruction region defined by a weld line that is formed on an opposite end from the air inlet port to redirect the pressurized air within the air bag wherein when inflating the air bag reaches a level at which the pressurized air counteract a liquid pressure within the liquid bag so as to urge the liquid toward the outlet port of the liquid bag.

15. The system of claim 14 wherein the weld line on the air bag is generally a rectangular in shape.

16. The system of claim 14 wherein the weld line on the air bag is generally a semi-circular in shape.

17. The system of claim 1 wherein the weld line on the air bag is generally a triangular in shape.

* * * * *